US007543405B1

(12) United States Patent
Ivey

(10) Patent No.: US 7,543,405 B1
(45) Date of Patent: Jun. 9, 2009

(54) ADJUSTABLE SCOPE MOUNTING SYSTEM

(76) Inventor: Stephen Ivey, 4121 Olivet Dr., Murfreesboro, TN (US) 37129

( * ) Notice: Subject to any disclaimer, the term of this patent is extended or adjusted under 35 U.S.C. 154(b) by 198 days.

(21) Appl. No.: 11/592,605

(22) Filed: Nov. 3, 2006

Related U.S. Application Data

(63) Continuation-in-part of application No. 11/032,705, filed on Jan. 11, 2005, now Pat. No. 7,140,143.

(51) Int. Cl.
*F41G 1/387* (2006.01)

(52) U.S. Cl. ..... 42/125

(58) Field of Classification Search ..... 42/124, 42/125, 126, 127, 128; 89/37.04
See application file for complete search history.

(56) References Cited

U.S. PATENT DOCUMENTS

| | | | | | |
|---|---|---|---|---|---|
| 282,551 | A | * | 8/1883 | McLean | 89/9 |
| 1,450,349 | A | * | 4/1923 | Belding | 42/126 |
| 1,926,151 | A | * | 9/1933 | Jung | 42/126 |
| 2,200,283 | A | * | 5/1940 | Lennon | 89/37.03 |
| 2,641,057 | A | | 6/1953 | Moore | |
| 2,663,083 | A | * | 12/1953 | Harms | 42/126 |
| 3,406,455 | A | | 10/1968 | Akin, Jr. | |
| 3,471,932 | A | | 10/1969 | Luning | |
| 4,026,054 | A | | 5/1977 | Snyder | |
| 4,317,304 | A | | 3/1982 | Bass | |
| 4,660,289 | A | | 4/1987 | Wilhide | |
| 5,086,566 | A | | 2/1992 | Klumpp | |
| 5,144,752 | A | | 9/1992 | Boeke et al. | |
| 5,400,539 | A | | 3/1995 | Moore | |
| 5,428,915 | A | | 7/1995 | King | |
| 5,703,317 | A | * | 12/1997 | Levilly et al. | 89/37.03 |
| 5,787,630 | A | | 8/1998 | Martel | |
| 6,293,041 | B2 | * | 9/2001 | Weaver | 42/94 |

(Continued)

*Primary Examiner*—Bret Hayes
(74) *Attorney, Agent, or Firm*—Waddey & Patterson, P.C.; Lucian Wayne Beavers; Howard H. Bayless

(57) ABSTRACT

An adjustable mounting system for a telescopic scope includes an adjustable elevation mount formed from a scope ring and an adjustable sub-base. A clevis portion of the scope ring holds an elevation pin that is received by a vertical slot in the adjustable sub-base. An internally longitudinal bore is disposed though the adjustable sub-base and an externally threaded barrel disposed in an opening of the longitudinal bore. A cylindrical elevation cam having an angled slot is disposed in the longitudinal bore and includes a positioning rod that extends through a bore disposed through the barrel. The angled slot receives the elevation pin as it extends through the vertical slot of the adjustable sub-base. The angled slot may be smooth or stepped. A bi-directional cam capture means is mechanically coupled to the elevation cam and provides for longitudinal displacement of the elevation cam through the cam bore. Detent mechanisms are incorporated in the cam capture means to provide audible or felt indication of elevation position. In various embodiments the cam capture means may be: a rack and pinion device operated by dial handle; a plunger attached to the positioning rod and extending through the rear of the sub-base, a lever attached to the positioning rod and extending through a notched slot in the side of the sub-base, a position dial including a dial thimble affixed to the positioning rod and threadably engaged with a barrel disposed on the sub-base. Other embodiments include a windage gib adjustably positioned in a bore of a lower portion of the sub-base and adapted to laterally offset the sub-base from the firearm rail.

5 Claims, 15 Drawing Sheets

U.S. PATENT DOCUMENTS

| | | | |
|---|---|---|---|
| 6,295,754 | B1 | 10/2001 | Otteman et al. |
| 6,418,657 | B1 | 7/2002 | Brown |
| 6,481,146 | B2 | 11/2002 | Carrier, III |
| 6,708,439 | B1 | 3/2004 | Laitala |
| 6,732,987 | B2 | 5/2004 | Wooten et al. |
| 6,772,550 | B1 | 8/2004 | Leatherwood |
| 7,140,143 | B1 | 11/2006 | Ivey |
| 2003/0192224 | A1 | 10/2003 | Kirk |
| 2004/0088898 | A1 | 5/2004 | Barrett |

* cited by examiner

ADJUSTABLE SCOPE MOUNTING SYSTEM

CROSS-REFERENCES TO RELATED APPLICATIONS

This application is a Continuation-In-Part application which claims benefit of co-pending U.S. patent application Ser. No. 11/032,705 filed Jan. 11, 2005 now U.S. Pat. No. 7,140,143, entitled "Adjustable Scope Mount" which is hereby incorporated by reference.

BACKGROUND OF THE INVENTION

The present invention relates generally to an apparatus and method of attaching and aligning an optical targeting or alignment system to a base. More particularly, this invention pertains to an apparatus and method of attaching and aligning optical sighting systems to a ballistic launcher. Even more particularly, this invention pertains to an adjustable mounting system for a telescopic scope.

It is long known in the art to provide mechanical means for adjusting the elevation of sighting and ranging devices mounted to a base. Aiming or sighting devices, laser target illumination devices and laser ranging devices are commonly mounted to ballistic projectile launchers, such as rifles, to survey equipment, and to other apparatus requiring alignment along a longitudinal axis. Common aiming or sighting devices include various types of telescopic optical scopes. Other aiming or sighting devices include telescopic and non-telescopic thermal imaging scopes and telescopic and non-telescopic amplified light imaging optical scopes.

Adjustable mounting systems are frequently used to mount telescopic scopes, and other similar aiming devices, upon barrels of rifles or other similar firearms. The most common telescopic scopes are non-amplified, optical telescopic scopes having front and rear mounting points. Such a telescopic scope is attached by means of a mounting system to the barrel of a rifle in a configuration having the rear sight of the scope adjacent to the rifle's breach and the front sight of the scope directed toward the muzzle of the rifle. The scope's sighting axis is approximately aligned with the bore axis of the rifle and is adjusted vertically in elevation and adjusted laterally in windage such that the point of aim observed by the shooter is the point of impact of the projectile at the desired range. Other elevation and windage adjustments may be necessary based on number of well known factors including wind speed and direction, temperature, humidity, projectile shape and mass, and powder mass and burn characteristics. Since projectiles follow a ballistic path, adjustments of elevation may be a critical factor for hitting targets at ranges approaching the maximum range of the cartridge-rifle combination.

The range in elevation adjustments needed for telescopic scopes mounted to high powered sporting and military rifles frequently exceeds the range in elevation adjustments achievable by elevation and windage adjustment mechanisms incorporated within the telescopic scope itself. These internal adjustment mechanisms of most telescopic scopes are less accurate over the outer portion of their adjustment ranges. The internal adjustment mechanisms frequently are positioned such that a shooter in the firing position cannot easily reach the internal adjustment mechanisms and cannot readily read the adjustment markings. Additionally, the internal adjustment mechanisms of telescopic scopes may be inadvertently displaced by acceleration experienced during recoil and other shocks.

Adjustable mounting systems are used to mount telescopic scopes so as to provide for larger ranges of elevation adjustment and greater resistance to displacement of the elevation adjustment mechanism during recoil or other shocks. One such adjustable telescopic scope mounting system is shown in FIGS. 1 and 3. This mounting system (herein referred to as the "Ivey 50 MOA" mounting system) was developed by Stephen Ivey and manufactured by Ivey Design of Murfreesboro, Tenn. The Ivey 50 MOA mounting system is adjustable within 1.0 m.o.a. (minute-of-arc) graduations between 0 m.o.a. and 50.0 m.o.a.

The Ivey 50 MOA mounting system includes an adjustable elevation mount 14 as the front mount and a pivoting mount 12 as the rear mount. The adjustable elevation mount 14 includes an adjustable sub-base 26 and the pivoting mount 12 includes a fixed sub-base 28. Each sub-base 26, 28 and corresponding base clamp 48, 50 are positioned upon the base rail 56 and are fixedly held in position by rail clamp bolts 52 positioned through each sub-base 26, 28 and corresponding base clamp 48, 50 and fastened with rail clam nuts 54. The base rail 56 is in turn rigidly attached to the rifle barrel or action. The Ivey 50 MOA mounting system may be adapted to fit various types of bases, including flat bases, dovetail bases and Picatinny bases among others.

The pivoting and adjustable mounts 12, 14 each include an upper assembly, commonly referred to as scope rings, having support bearings with an internal diameter approximately the same as the diameter of the telescopic scope at its mounting points. These scope rings each include an upper ring cap 20 that is fastened to the lower ring portion 22 by ring bolts so as to rigidly hold the telescopic scope to the support bearings. The lower portion 22 of each scope ring further includes a clevis 23 portion forming a clevis opening adapted to receive a portion of a sub-base 26, 28. For each scope ring, the lower ring portion 22 and the sub-base 26, 28 are bolted to form a clevis connection. The adjustable elevation mount 14 and a pivoting mount 12 form a rigid assembly when holding a telescopic scope.

The pivoting mount 12 of the Ivey 50 MOA mounting system is proximate the rear sight of the telescopic scope when a scope is mounted on a rifle. The lower ring portion 22 of this mount has two clevis pivot holes 106 that are aligned with the base pivot hole 107 of the fixed sub-base 28. These holes form a through hole that is closely sized in diameter to the diameter of a pivot pin bolt 30 extending through these holes and fastened with a nut. This type of clevis connection allows the scope ring of the pivoting mount 12 to pivot around the pivoting mount 12 upon loosening of the clevis connection.

The adjustable elevation mount 14 is proximate the front sight of the telescopic scope. The lower ring portion 22 of this mount has two clevis pivot holes 106 that are aligned with the vertical slot 108 (not shown in FIG. 1, but as shown in FIG. 4) of the adjustable sub-base 26. Referring again to FIG. 1, an elevation pin 31 extends through the clevis pivot holes 106 and the vertical slot 108 and is fastened with a nut. This clevis connection allows the scope ring of the adjustable elevation mount 14 to travel along a vertical direction shown by arrow 104 upon loosening of the clevis connection.

The adjustable elevation mount 14 includes a cylindrical bore disposed longitudinally through the adjustable sub-base 26 and having a first internally threaded opening receiving a locking setscrew 42. A second internally threaded opening receives an externally threaded barrel 40. The barrel has an internally threaded barrel bore that receives a threaded and extending portion of a micrometer head 39. The locking setscrew 42 and the extending portion of the micrometer head 39 are disposed in opposition.

An elevation cam 36 is slidably disposed in the cylindrical bore between the locking setscrew 42 and the extending portion of the micrometer head 39. The elevation cam 36 has a cylindrical body with flat faced ends and an angled slot 110 cut laterally through the cylindrical body. The angled slot 110 receives the elevation pin 31 as it extends through the vertical slot 108 of the adjustable sub-base 26. The locking setscrew 42 and the extending portion of the micrometer head 39 are each in contact with but not affixed to a flat faced end of the elevation cam 36. Adjustments of the locking setscrew 42 and the micrometer head 39 position the elevation cam 36 along a longitudinal direction of travel shown by arrow 102. The angled slot 110 is adapted to provide a track for forcing the elevation pin 31 to travel vertically when the elevation cam 36 is moved past the elevation pin 31, thus lowering and lifting the sight ring of the adjustable elevation mount 14.

Elevation adjustment of the Ivey 50 MOA mounting system is accomplished by using hex key wrenches to loosen the pivot pin 30 and the elevation pin 31 fixing nuts connecting the scope rings to the sub-bases 26, 29 on the pivoting and adjustable mounts 12, 14, respectively. A hex key wrench is then used to loosen the locking setscrew 42 butted to the rear of the elevation cam 36 so as to allow travel of the elevation cam 36. The micrometer head 39 is adjusted to a new, selected position. The locking setscrew 42 is retightened against one face of the elevation cam 36 so as to reposition the elevation cam 36 in firm contact against the opposing the micrometer head 39. Finally the pivot pin 30 and the elevation pin 31 are retightened using hex key wrenches.

The Ivey 50 MOA mounting system and other prior art systems have several disadvantages when used in demanding environments. First, elevation adjusting dials of many are exposed. For the Ivey 50 MOA mounting system the micrometer head extends in front of the mounting system and the corresponding elevation adjusting dials of other prior art systems extend laterally from their mounting systems. When hunting in rough terrain, obstacles may strike these exposed elevation adjusting dials and cause movement and misadjustment of the elevation adjustment set in the mounting system. Loss of an external tool would render the adjustment mechanisms unusable until such time as a new tool can be procured. Use of external tools, such as hex wrenches, is disadvantageous when it is necessary to make an elevation adjustment quickly, quietly and with a minimum of motion. Finally, when a shooter is in the shooting position it is very difficult to make an elevation adjustment to the mounting system without movement out to the shooting position.

The Ivey 50 MOA mounting system is susceptible to interrupted or incorrect positioning of the elevation cam 36 if either the locking setscrew 42 or the micrometer head extending portion 39 do not fully and firmly contact the elevation cam 36. Oil, dirt or debris may create a physical offset between a flat face of the elevation cam 36 and either of these positioning means. Such an offset causes small variations in vertical travel of the scope ring of the adjustable elevation mount 14 and, thus, causes a reduction in the smoothness, accuracy and precision of the elevation adjustment.

What is needed, then, is an adjustable mounting system for a telescopic scope that provides an elevation adjustment dial adapted to be used while the shooter is in the shooting position, that provides a means for making elevation adjustments quickly, quietly and with a minimum of motion, that provides a means for making elevation adjustment without the use of external tools (tool-less elevation adjustments) and provides an elevation adjustment dial that is protected from obstacles.

Additionally, what is needed is an adjustable mounting system for a telescopic scope that provides for smooth, accurate and precise transmission of bi-directional travel of the elevation cam mechanism within the bore of the adjustable sub-base and so as to prevent oil, dirt or debris from distorting the positioning of the elevation cam mechanism by the elevation adjustment dial.

BRIEF SUMMARY OF THE INVENTION

The present invention includes an adjustable mounting system for a telescopic scope having an adjustable elevation mount formed from a scope ring and an adjustable sub-base. A clevis portion of the scope ring holds an elevation pin that is received by a vertical slot in the adjustable sub-base. An internally threaded longitudinal bore is disposed through the adjustable sub-base and an externally threaded barrel is disposed in an opening of the longitudinal bore. A cylindrical elevation cam having an angled slot is disposed in the longitudinal bore and includes a positioning rod that extends through a bore disposed through the barrel. The angled slot receives the elevation pin as it extends through the vertical slot of the adjustable sub-base. The positioning rod has a shoulder portion that receives a set of roller thrust bearings and has a threaded distal end.

In a first preferred embodiment, an internally threaded dial thimble marked with graduations about its circumference extends over the positioning rod distal end and shoulder portion to engage the external threads of the barrel. A thimble locking nut engages the threaded distal end of the positioning rod so as to affix the dial thimble to the positioning rod. Bi-directional longitudinal travel of the elevation cam is accomplished through bi-directional rotation of the dial thimble. Measurements of the adjustment of the dial thimble are provided by horizontal and vertical lines marked on the barrel body and corresponding to revolutions of the dial thimble that indicated the position of the elevation cam in minutes-of-angle (m.o.a.).

A second preferred embodiment of the adjustable mounting system of the present invention includes an elevation cam adapted to receive a floating angular cut wedge plunger adapted to engage the elevation pin during elevation adjustments so as to provide continuous engagement of the elevation pin by a wedge face. The wedge plunger is spring biased and disposed within a bore in the elevation cam penetrating from the flat surface opposite the positioning rod into the angled slot. Additionally, a spring biased floating button is disposed in an access bore in the bottom of the adjustable sub-base. The access bore penetrates to the longitudinal bore housing the elevation cam. The floating button is disposed adjacent to the lower surface of the elevation cam and exerts a bias forcing the elevation cam into continuous contact with the upper surface of the longitudinal bore.

In a third preferred embodiment of the adjustable mounting system of the present invention, a selected stepped angle slot is disposed in a bi-directional elevation cam to provide several selected discrete coarse elevation settings. The elevation cam cylinder is mechanically captured by a gear rack attached to the elevation cam positioning rod. The gear rack is mechanically coupled to a pinion gear driven by an adjustment side knob controlled by the operator. Detents extend from the outer circumference of the adjustment side knob to the detent seats in the housing. The mechanism is adapted such that the amount of rotation of the side knob that results in displacement of the detents from one detent seat to an adjacent detent seat corresponds to the displacement of the elevation cam such that the elevation pin is displaced from one step of the stepped angled slot to an adjacent step of the slot. The detents are biased so as to prevent accidental operation while allowing easy operation of the adjustment side knob. Additionally, the detents are adapted to provide an audible and/or a felt click sufficient to be detected by the operator but not generally detectable by others, even if nearby.

A fourth preferred embodiment of the adjustable mounting system of the present invention includes a bi-directional elevation cam captured to a position dial modified to cooperate with a detent mechanism disposed within the adjustable sub-base body. An adjustable elevation mount includes an elevation cam cylinder with a smooth angled slot and having a positioning rod captured via a connection stud to an externally threaded dial thimble. The externally threaded dial thimble is disposed within and rotatably engages the internal threads of a barrel affixed to the sub-base body. The thimble has a series of detent seats disposed in a circumferential rim proximal to the elevation cam cylinder. A detent mechanism is sufficiently biased so as to prevent accidental operation but also allow easy operation of the thimble. Additionally, the detent mechanism is adapted so as to provide an audible and/or a felt click for each change of position of the detent rod. This preferred feature provides for quick and reliable adjustment of elevation from one elevation setting to another in low light or darkness.

Additionally, the fourth preferred embodiment includes a spherical pivot mount modified to allow rotation in three degrees of freedom. A spherical pivot mount includes a spherical pivot bushing disposed in a hemispherical seat in a threaded cylindrical bore ending in a generally hemispherical cavity longitudinally disposed in the fixed sub-base. An oversized pivot hole is laterally disposed in the sub-base body so as to intersect the hemispherical cavity. Two cylindrical bushings are disposed in the oversized pivot hole on either side of the spherical bushing. A ring bearing clevis is positioned over the sub-base body and a pivot pin is disposed through the bores of the bushings which are sized such that their combined lateral dimension provides a close fit with the inner clevis dimension. The ring bearing clevis may then be rotated about a vertical axis and about longitudinal axis relative to fixed sub-base body by rotation of spherical bushing relative to the spherical seats. The ring bearing clevis may also be rotated about a lateral axis relative to fixed sub-base body both by rotation of spherical bushing relative to the spherical seats and by rotation of the pivot pin relative to the spherical seat. A locking setscrew having a concave hemispherical seat is threaded into the cylindrical bore so as to lock the spherical bushing in position relative to the spherical set. A locking nut is tightened so as to fix the ring bearing clevis upon fixed sub-base body.

This preferred feature provides for quick and reliable adjustment of the adjustable mounting system to account for miss-alignment or warping of the firearm base rail and can provide a gross windage adjustment.

A fifth preferred embodiment of the adjustable mounting system of the present invention uses windage gibs inserted in modified sub-base bodies of a scope mount so as to cause the aim-point of the telescopic sight mounted in the adjustable mounting system to change in relation to the base rail axis and the bore of the firearm. Two threaded gib bores are disposed in the lower portion of an adjustable sub-base so as to intersect the sub-base axial slot fitting the base rail and align with the to the center edge of the base rail. A gib has a gib "V" seat and is inserted into each gib bore so as to receive the protruding "V" surface of the base rail. A setscrew is threaded into each gib bore and is rotated as necessary to displace each gib to its seated adjustment point. A locknut is attached to the exposed portion of each setscrew to lock each combination of setscrew and gib into their adjusted position and provide a selected lateral displacement of the adjustable sub-base relative to the base rail.

Accordingly it is an object of the present invention to provide an adjustable mounting system for a telescopic scope having an elevation adjustment dial adapted to provide smooth and accurate transmission for bi-directional travel of the elevation cam.

It is an additional object of the present invention to provide an adjustable mounting system for a telescopic scope having an elevation adjustment minimum adapted to be used while the shooter is in the shooting position, adapted to make elevation adjustments quickly, quietly and with a minimum of motion, and adapted to be protected from obstacles.

It is another object of the present invention to provide an adjustable mounting system for a telescopic scope having an elevation adjustment means adapted for making elevation adjustment without the use of external tools (tool-less elevation adjustments).

It is yet another object of the present invention to provide an adjustable mounting system for a telescopic scope having an elevation adjustment means adapted for making quick and reliable adjustment of coarse elevation from one elevation setting to another in low light or darkness.

It is still yet another object of the present invention to provide an adjustable mounting system for a telescopic scope having an elevation adjustment means adapted for making rapid tool-less adjustment of sight mount for coarse windage adjustment and for inherent miss-alignment in the rail base.

BRIEF DESCRIPTION OF THE SEVERAL VIEWS OF THE DRAWINGS

FIG. 13*b* and FIG. 13*c* are combined to show a longitudinal cross-sectional view of the adjustable mounting system of FIG. 13*a*.

| LIST OF ELEMENTS | |
|---|---|
| 10. | adjustable mounting system |
| 12. | pivoting mount |
| 14. | adjustable elevation mount |
| 20. | ring bearing cap (upper) |
| 22. | ring bearing clevis (lower) |
| 24. | ring bolts |
| 26. | adjustable sub-base body |
| 27. | lower portion of sub-base body |
| 28. | fixed sub-base body |
| 29. | sub-base axial slot |
| 30. | pivot pin |
| 31. | elevation pin |
| 32. | ratchet lever |
| 34. | pivot pin washer |
| 35. | cam bore |
| 36. | elevation cam cylinder |
| 37. | elevation cam positioning rod |
| 38. | dial thimble |
| 39. | micrometer head |
| 40. | barrel |
| 42. | locking setscrew |
| 44. | roller bearing |
| 45. | thrust bearing |
| 46. | thimble locking nut |
| 48. | sub-base to rail double clamp |
| 50. | sub-base to rail single clamp |
| 52. | rail clamp bolt |
| 53. | rail clamp bolt bore |
| 54. | rail clamp nut |
| 56. | base rail |

-continued

| LIST OF ELEMENTS | |
|---|---|
| 57. | base rail axis |
| 58. | wedge plunger |
| 60. | spring washer |
| 62. | setscrew |
| 64. | button gib |
| 66. | spring washer |
| 68. | setscrew |
| 70. | wedge face |
| 72. | lifter spring |
| 74. | lifter spring cavity |
| 76 | elevation cam O-ring |
| 78 | elevation cam O-ring groove |
| 79 | pinion gear shaft |
| 80 | pinion gear |
| 81 | pinion bore |
| 82 | gear rack |
| 83 | rack bore |
| 84 | connection stud |
| 85 | rack and pinion housing |
| 86 | detents |
| 87 | detent seats |
| 88 | shaft retaining groove |
| 89 | adjustment side knob |
| 90. | gib |
| 91. | gib bore |
| 92. | gib "v" seat |
| 94. | base rail "V" surface |
| 95. | base rail center edge |
| 96. | set screw |
| 98. | locknuts |
| 99. | spacer washers |
| 100. | direction of muzzle |
| 102. | direction of elevation cam travel |
| 104. | direction of ring travel |
| 106. | clevis pivot hole |
| 107. | base pivot hole |
| 108. | vertical slot |
| 110. | angled slot |
| 111 | stepped angled slot |
| 120. | thimble detent notch |
| 122 | thimble circumference rim |
| 124 | sub-base detent bore |
| 125 | cam detent bore |
| 126 | detent spring |
| 128 | detent rod |
| 129 | hemispherical end |
| 212. | spherical pivot mount |
| 214. | fixed sub-base body |
| 216. | cylindrical bore |
| 218. | hemispherical cavity |
| 219. | hemispherical seat |
| 220. | spherical bushing |
| 222 | spherical bushing inner bore |
| 224 | pivot pin |
| 225 | oversized pivot hole |
| 226 | cylindrical bushing |
| 228 | cylindrical bushing inner bore |
| 230 | locking set screw |
| 232 | concave hemispherical seat |
| 234 | inner clevis dimension |
| 236 | pivot pin washers |
| 238 | locking handle |
| 239 | locking nut |
| 240 | first arc of rotation |
| 242 | second arc of rotation |
| 244 | third arc of rotation |

DETAILED DESCRIPTION OF THE INVENTION

First Embodiment

Figure 1:
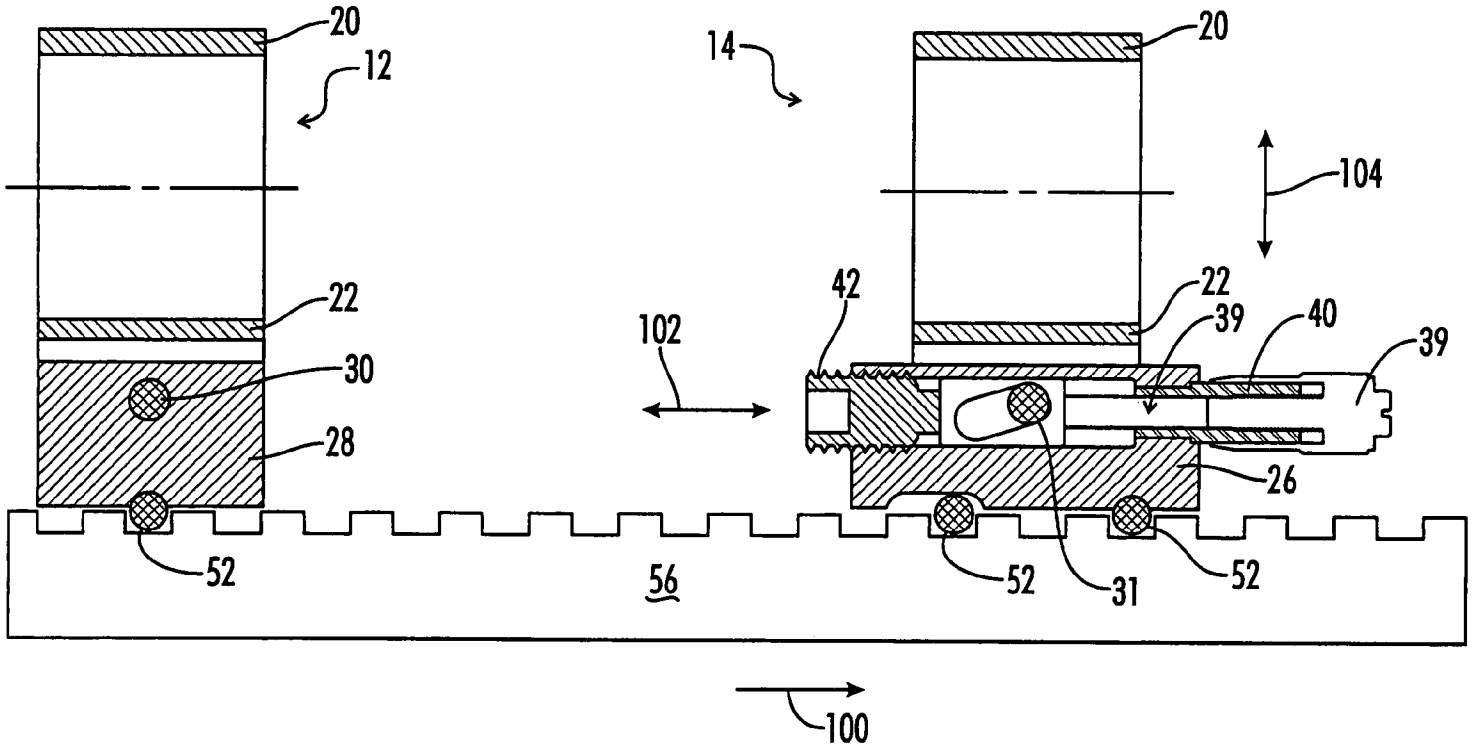
FIG. 1 (PRIOR ART)
FIG. 1 is a longitudinal cross-sectional view of a prior art adjustable mounting system for a telescopic scope.
Figure 2:
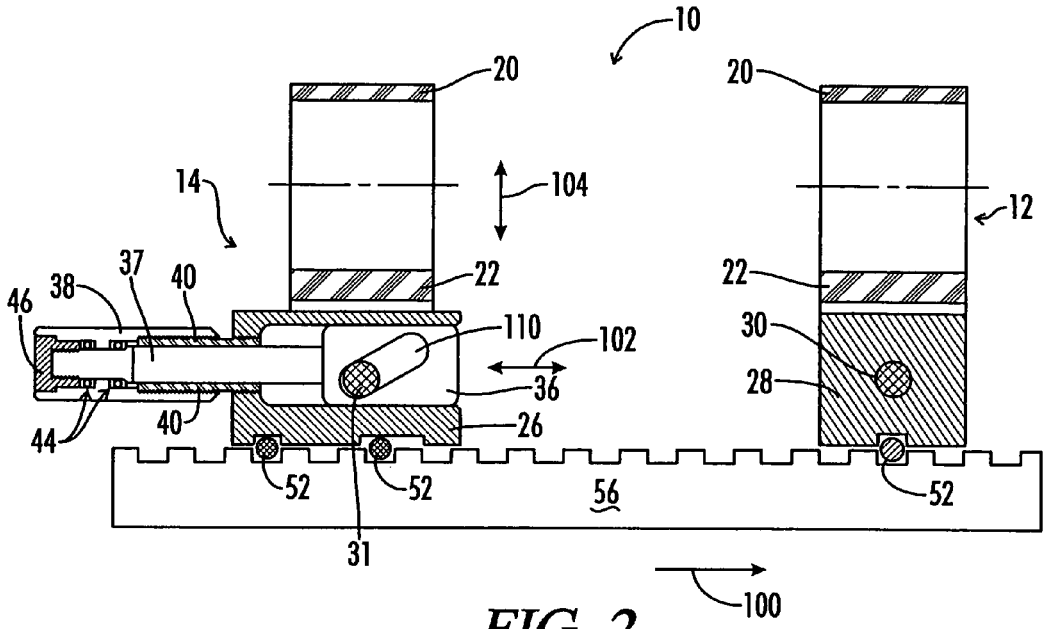
FIG. 2 is a longitudinal cross-sectional view of a first preferred embodiment of the adjustable mounting system of this invention.
Figure 3:
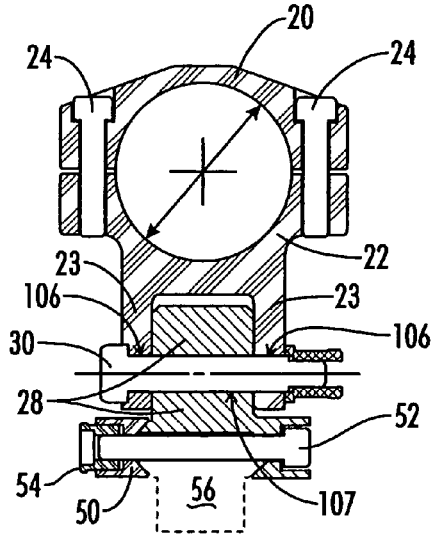
FIG. 3 is a lateral cross-sectional view of the pivoting mount shown in FIGS. 1 and 2.
Figure 4:
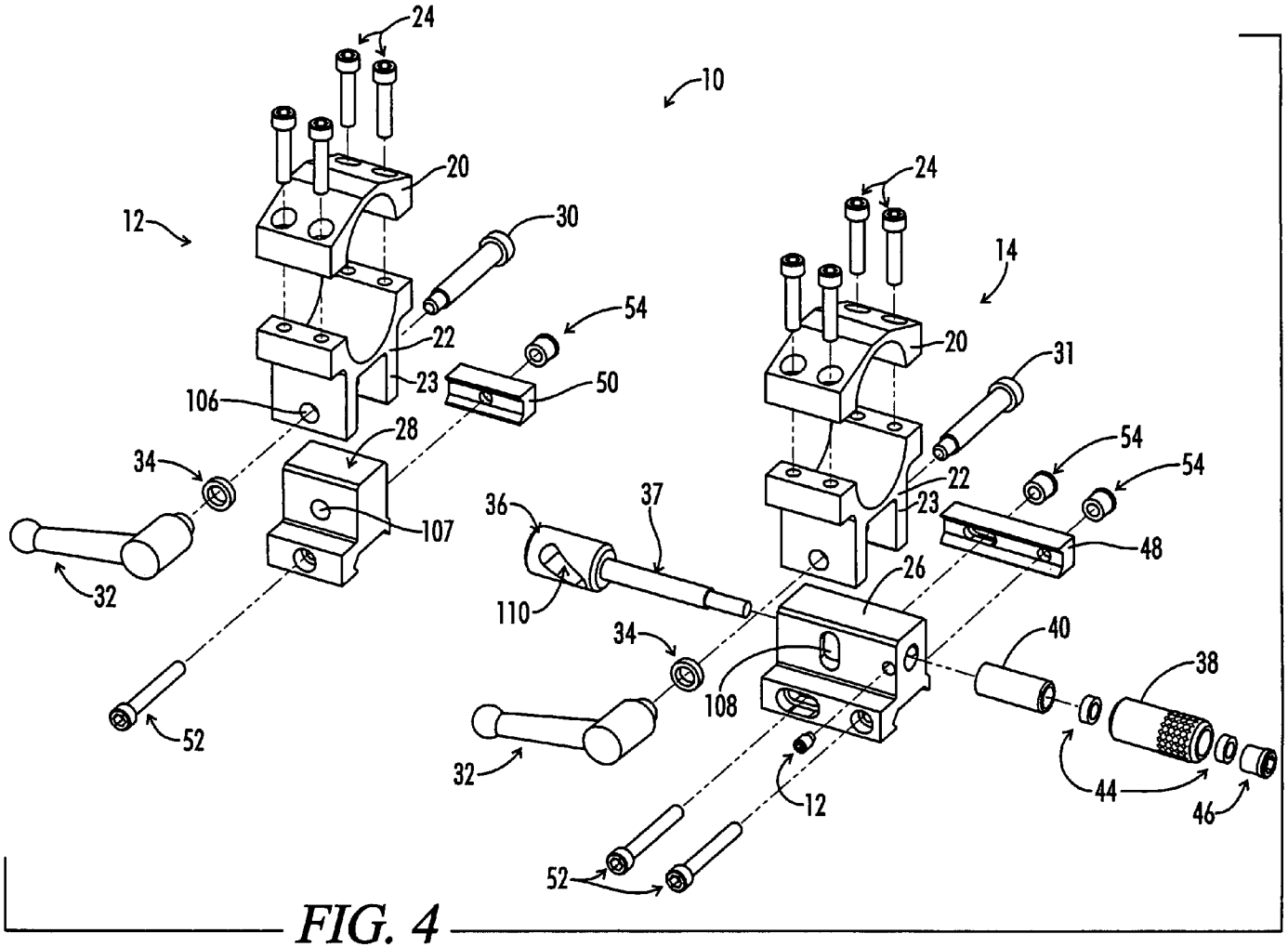
FIG. 4 is an exploded oblique reverse view of the adjustable mounting system shown in FIG. 2.

One preferred embodiment of the present invention is shown in FIGS. 2, 3 and 4. This embodiment of the mounting system 10 of the present invention is adjustable within 1.0 m.o.a. graduations between 0 m.o.a. and 150.0 m.o.a. This embodiment incorporates the scope rings and pivoting mount 12 of the Ivey 50 MOA mounting system, with the exception that a ratchet lever 32 is used to tighten or loosen the pivot pin 30. This modification allows for rapid, quiet tightening or loosening the pivot pin 30 without the use of external tools.

Referring to FIG. 2, the mounting system of the present invention includes a pivoting mount 12 located forward of the adjustable elevation mount 14 as indicated by the direction arrow 100. The elevation adjustment dial 38 is disposed in the rear portion of the adjustable elevation mount 14 and extends longitudinally further rearward. When in a shooting position, this configuration places the elevation adjustment dial adjacent to the shooter's eye and within easy reach of the shooter's hand. In this configuration, the elevation adjustment can easily be used to make elevation adjustments quickly, quietly and with a minimum of motion while the shooter remains in the shooting position. This configuration also places the adjustment dial 38 in a protected position between the rifle and the mounted telescopic scope, and, thus, reduces the likelihood of the adjustment dial 38 being struck by an obstacle.

Referring now to FIGS. 2 and 4, one novel feature of the present invention is the adjustable elevation mount 14 formed from a scope ring and an adjustable sub-base 26. By mechanically capturing the elevation adjustment dial 38 to the elevation cam 36, the elevation adjustment dial provides bi-directional control of elevation adjustments of the adjustable telescopic mounting system of this invention.

The novel adjustable elevation mount 14 includes a scope ring attached to a sub-base 26 through a clevis connection. A clevis portion 23 of the scope ring has two clevis pivot holes 106 that are aligned with the vertical slot 108 of the adjustable sub-base 26. An elevation pin 31 extends through the two clevis pivot holes 106 and is received by a vertical slot 108 in the adjustable sub-base 26. The elevation pin 31 is fastened with a quick release ratchet leaver 32. This clevis connection allows the scope ring of adjustable elevation mount 14 to travel along a vertical direction shown by arrow 104 upon loosening of the clevis connection. The vertical travel of the scope ring of adjustable elevation mount 14 allows for elevation of the rear scope ring in an arc path pivoting about the single pivot pin 30 of the fixed sub-base assembly 28.

An internally threaded longitudinal bore is disposed though the adjustable sub-base 26 so as to intersect the vertical slot 108. In the embodiment shown, an externally threaded barrel 40 having a bore is affixed in the internally threaded rear opening of the longitudinal bore. A cylindrical elevation cam 36 having an angled slot 110 is disposed in the longitudinal bore. The cylindrical elevation cam 36 includes a positioning rod 37 that extends through the longitudinal bore and further extends through the barrel bore. The angled slot 110 receives the elevation pin 31 as it extends through the vertical slot 108 of the adjustable sub-base 26. The positioning rod 37 has a shoulder portion that receives a set of roller thrust bearings 44 and has a threaded distal end. An internally threaded dial thimble 38 marked with graduations about its circumference engages the external threads of the barrel 40. A thimble locking nut 46 engages the threaded distal end of the positioning rod. This thimble locking nut 46 forces the set of roller thrust bearings 44 against the shoulder portion of the positioning rod 37. The dial thimble 38 is thus rotably affixed to the positioning rod 37. In this configuration, bi-directional longitudinal travel of the elevation cam 36 is caused through bi-directional rotation of the dial thimble 38. The mechanical capturing of the thimble dial 38 to the elevation cam 36 provides bi-directional control of elevation adjustments of the adjustable telescopic mounting system of this invention. The elevation adjustment is determined by the travel of the elevation pin 31, which is vertically positioned in the vertical slot 108 by the corresponding longitudinal position of the angled slot 110 of the elevation cam 36. The rotation of the dial thimble 38 provides locomotion to the elevation cam 36, moving the position of the angled slot 110 in relation to the vertical slot 108 of the adjustable sub-base 26. This relative motion of the angled slot 110 and the vertical slot 108 results in vertical travel of the elevation pin 31 and of the scope ring of adjustable elevation mount 14. The vertical travel of the scope ring of the adjustable elevation mount 14 allows for elevation of the rear scope ring in an arc path pivoting about the single pivot pin 30 of the fixed sub-base assembly 28. Such captured bi-directional control of elevation adjustments results in increased accuracy, limited recoil effects, and simplified field adjustment mechanisms as compared to prior art systems, including the Ivey 50 MOA mounting system.

Measurements of the adjustments of the dial thimble 38 are provided by horizontal and vertical graduations marked on the barrel body 40 and corresponding to revolutions of the dial thimble 38. The graduations on the dial thimble 38 work in conjunction with the fixed graduations marked on the barrel 40 to provide repeatable "Vernier" type readings of the adjustment setting that indicated the position of the elevation cam 36 in minutes-of-angle (m.o.a.).

Second Embodiment

Figure 5:
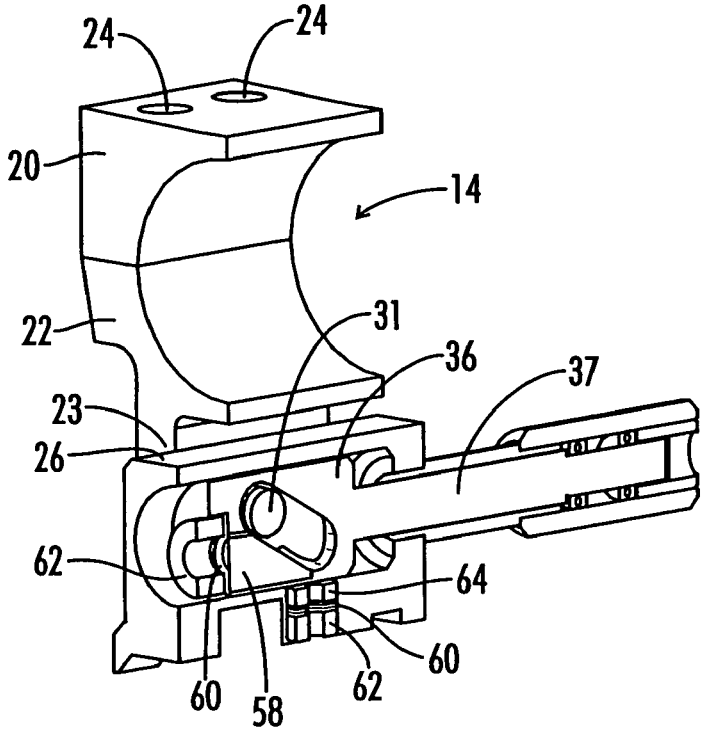
FIG. 5 is an oblique cross-sectional view of a detail of a second preferred embodiment of the adjustable mounting system of the present invention.
Figure 6:
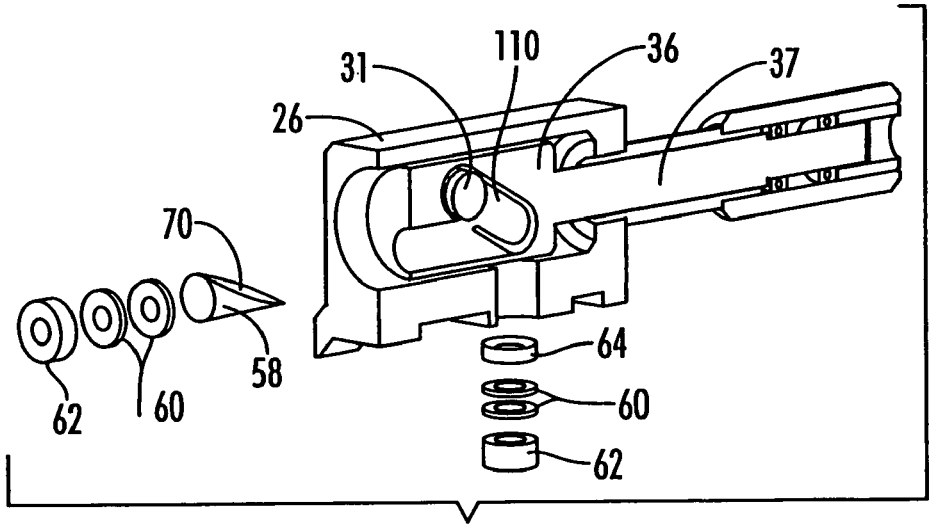
FIG. 6 is an exploded view of the adjustable mounting system shown in FIG. 5.

Referring now to FIGS. 5 and 6, a second embodiment of the adjustable mounting system of the present invention is shown. The bi-directional elevation cam 36 has been modified to accept a floating angular-cut wedge plunger 58. A close fitting plunger bore is disposed in the elevation cam 36 such that the plunger bore penetrates into the angular slot 110. The wedge plunger 58 has a wedge face 70 with a slope approximating the slope of the angular slot 110. The wedge plunger 58 is disposed in the plunger bore and extends into the angular slot 110. Spring washers 60 backed by a setscrew 62 provide an axial bias that forces the wedge plunger 58 into continuous contact with the elevation pin 31. This axial bias of the wedge plunger 58 pushes the elevation pin 31 against the opposite wall of the angled slot 110 and provides for continuous capture of the elevation pin 31 by the elevation cam 36 at all points throughout the travel of the elevation cam 36 during elevation adjustments. This additional capture feature improves repeatability and precision.

Additionally, a spring biased floating button 64 is disposed in an access bore in the bottom of the adjustable sub-base 26. The access bore penetrates to the longitudinal bore housing the elevation cam 31. The floating button 64 is disposed adjacent to the lower surface of the elevation cam 31 and exerts a bias force against the bottom of the elevation cam 31 so as to force the elevation cam into continuous contact with the upper surface of the longitudinal bore. The floating button 64 is biased by a set of spring washers 66 backed by a setscrew 62 of which pressure can be finely adjusted for optimum performance.

Advantageously, the continuous mechanical capture features of the wedge plunger 58 and of the floating button 64 combine to provide improved repeatability and precision. In one example, tests with an adjustable mounting system of this invention having the wedge plunger 58 and the floating button 64 resulted in a tolerance of +/−0.5 inches at a range of 100 yards. Without the wedge plunger 58 and the floating button 64 tests of the adjustable mounting system resulted in a tolerance of only +/−2.0 inches at a range of 100 yards.

Third Embodiment

The adjustable mounting system of this invention is a novel improvement over the prior art in that the elevation cam is mechanically captured to a cam capture means so as to provide bi-directional control of elevation adjustments of the adjustable telescopic mounting system. The previously described embodiments provided a position dial as the cam capture means. However, in certain conditions, such as in covert military operations where there is low light or darkness, the elevation markings of the dial thimble may not be visible and use of an illumination device such as a flashlight or illuminated dial markings would be undesirable. Additionally, fine elevation adjustments contained within a sighting device held by the adjustable mounting system of the previously described embodiments are frequently sufficient to adjust between discrete coarse elevation settings of an adjustable elevation mount.

Figure 7:
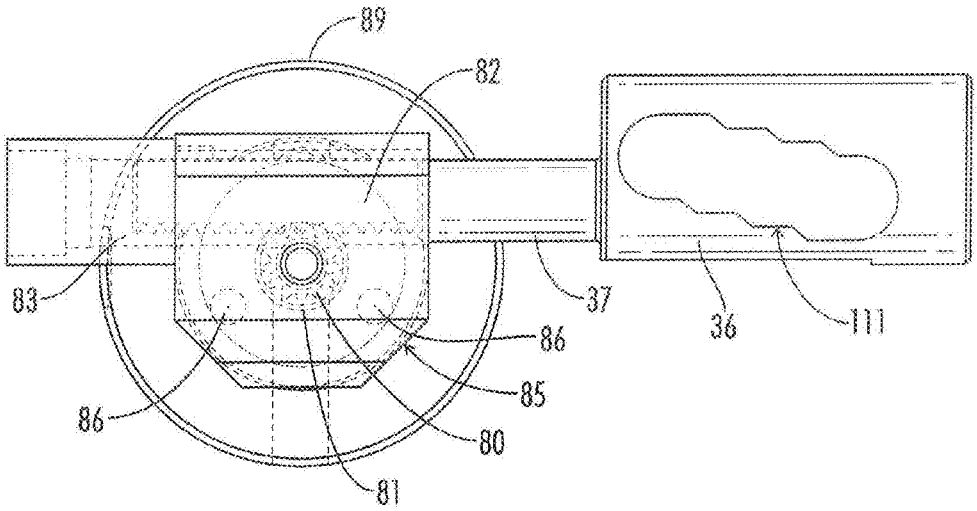
FIG. 7 is a detailed view of an elevation cam and an elevation cam positioning mechanism of a third preferred embodiment of the adjustable mounting system of the present invention.
Figure 8:
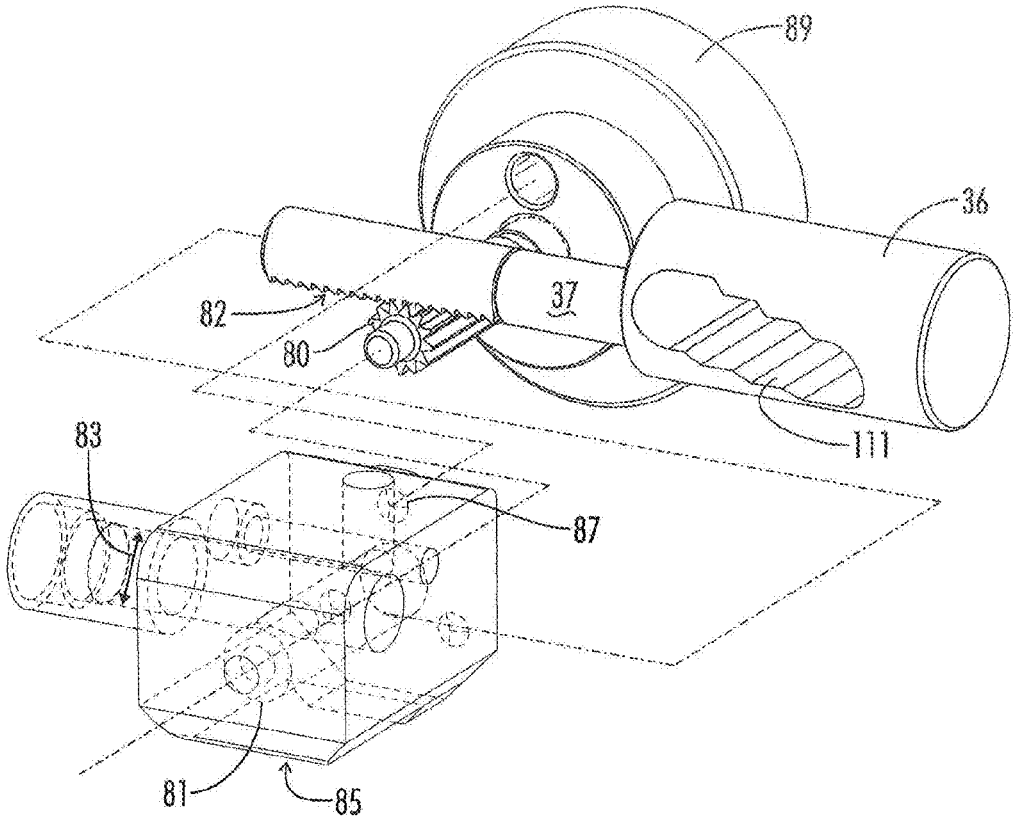
FIG. 8 is a detailed partially exploded view of the apparatus of FIG. 7, further including a housing.
Figure 9:
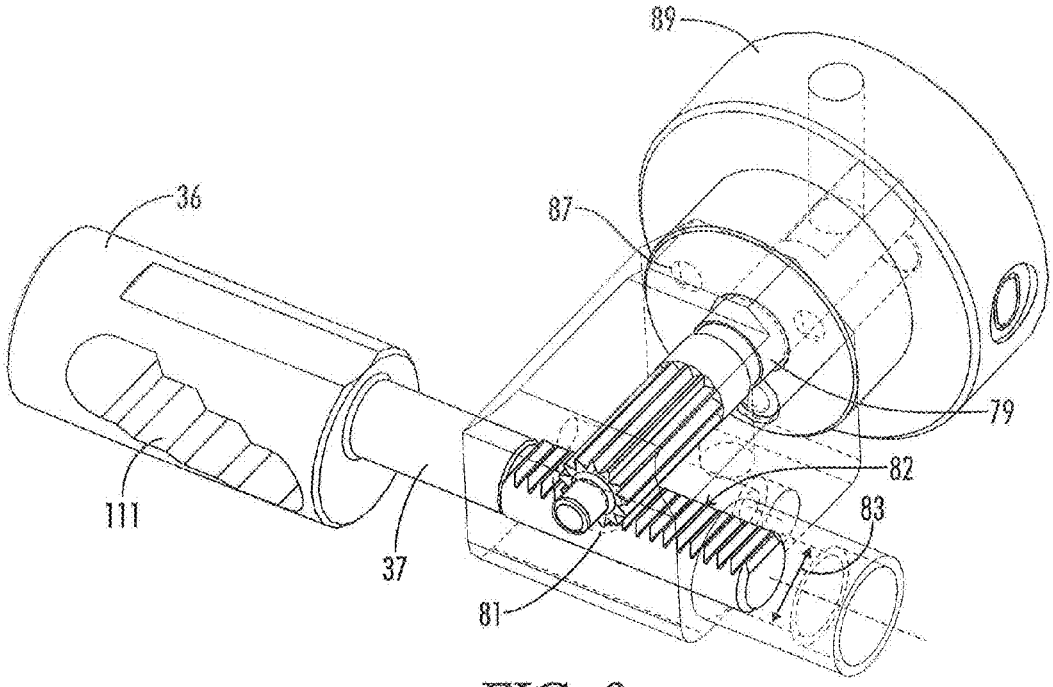
FIG. 9 is an oblique underside view of the apparatus of FIG. 8.

A third preferred embodiment of the adjustable mounting system of the present invention has provides for both of these desirable features. In this embodiment, as shown in FIGS. 7-9, the bi-directional elevation cam 36 has been modified to have several coarse elevation settings by employing a selected stepped angle slot 111 in lieu of the smooth angled slot of the previously described embodiments. Additionally, the elevation cam cylinder 36 has been mechanically captured by a gear rack 82 attached to the elevation cam positioning rod 37. The gear rack 82 is mechanically coupled to a pinion gear 80 that is driven by a pinion gear shaft 79 turned by an adjustment side knob 89 controlled by the operator. This cam capture means is better adapted to rapid adjustment of coarse elevation.

Figure 10A:
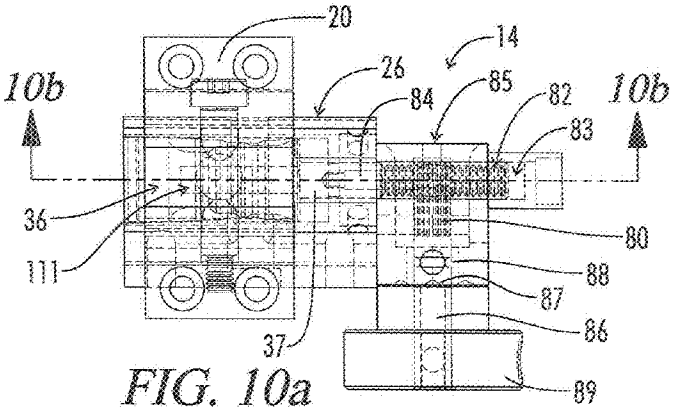
FIG. 10*a* is an overhead view of adjustable scope mount of the third preferred embodiment of the adjustable mounting system of the present invention.
Figure 10B:
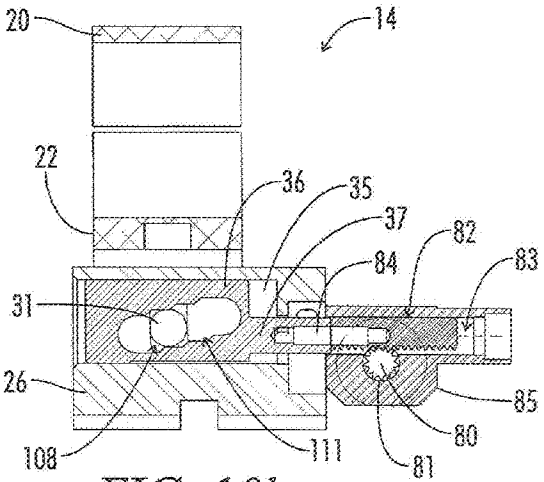
FIG. 10*b* is a longitudinal cross-sectional view of the apparatus of FIG. 10*a*.
Figure 10C:
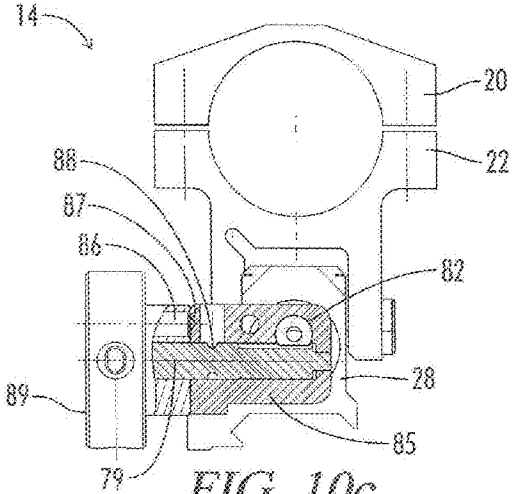
FIG. 10*c* is a lateral cross-sectional view of the apparatus of FIG. 10*a*.
Figure 11A:
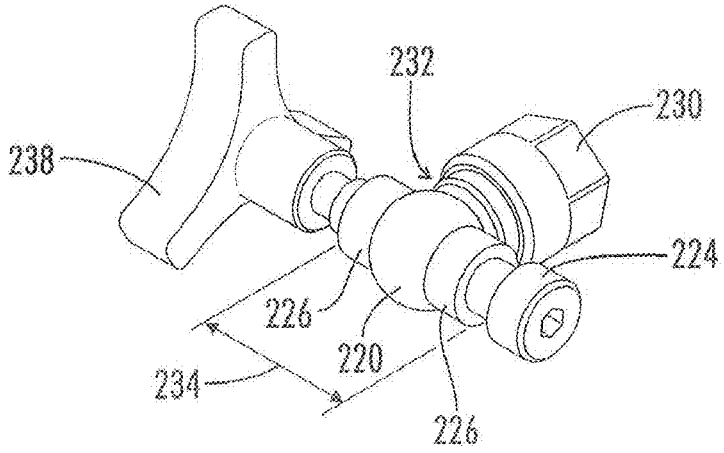
FIG. 11*a* is a detailed view of a spherical pivot pin assembly of a fourth preferred embodiment of the adjustable mounting system of the present invention.
Figure 11B:
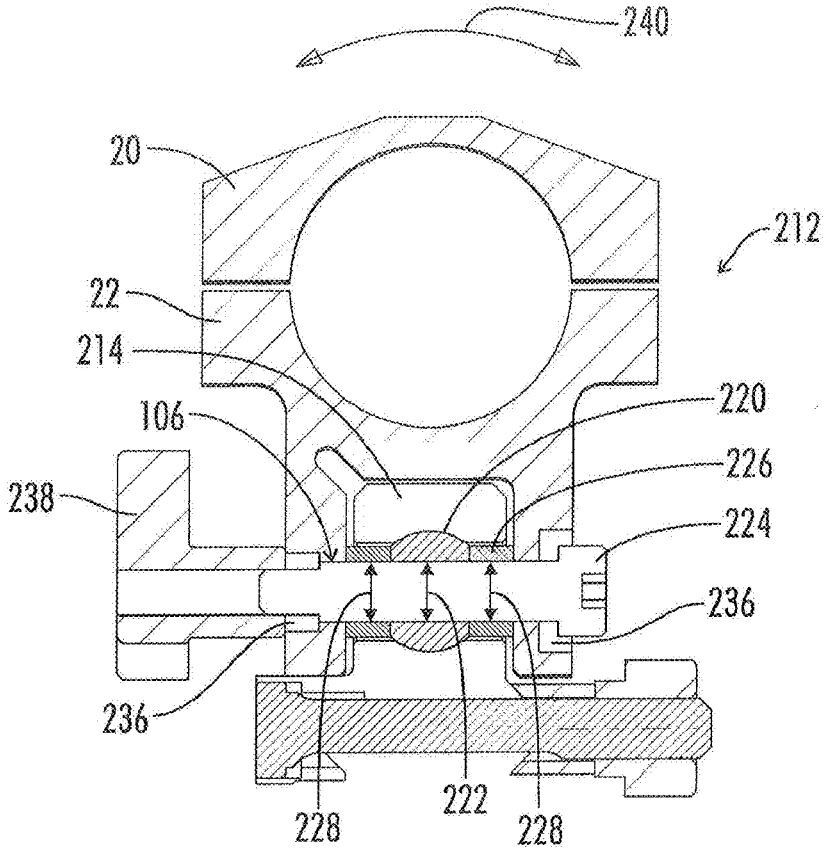
FIG. 11*b* is a lateral cross-sectional view of a pivoting mount of the fourth preferred embodiment of the adjustable mounting system of the present invention.

Described in greater detail, FIGS. 10*a*-10*c* show an adjustable elevation mount 14 of this third preferred embodiment having the rack and pinion housing 85 affixed to the rear surface of the adjustable sub-base body 26 in place of the barrel and thimble adjustment dial of the previously described embodiments. The elevation pin 31 is shown in FIG. 10*b* disposed in the stepped angled slot 111 of the elevation cam cylinder 36, which is itself disposed in cam bore 35 of the adjustable sub-base body 26. The elevation cam positioning rod 37 is attached to the gear rack 82 by connection stud 84. The gear rack 82 is slidably disposed in a rack bore 83. A pinion bore 81 intersects the rack bore 83 and a pinion gear 80 is rotatably disposed within the pinion bore 81 so as to engage the gear rack 82. A pinion gear shaft 79 is attached to the pinion gear 80 and extends through the pinion bore 81 so as to extend beyond the side of the adjustable sub-base body 26. A shaft retaining groove 88 is shown disposed in the pinion gear shaft 79. Any of a number of conventional retaining means may be inserted into the retaining groove 88 to allow rotation of the pinion gear shaft 79 within the pinion bore 81 while preventing the pinion gear shaft 79 from sliding out of the pinion bore 81.

The adjustable elevation mount 14 of this embodiment is operated by means of an adjustable side knob 89 affixed to the end of the pinion gear shaft 79 distal to the pinion gear 80. Detent seats 87 are disposed in the side of the adjustable sub-base body 26 and detents extend from the outer circumference of the adjustment side knob 80 to the detent seats 87. Preferably, the detent seats 87 are sized and positioned and the rack and pinion gearing is adapted such that the amount of rotation of the side knob 89 that results in displacement of the detents 86 from one detent seat 87 to an adjacent detent seat 87 corresponds to the displacement of the elevation cam 36 such that the elevation pin 31 is displaced from one step of the stepped angled slot 111 to an adjacent step of the slot 111. Preferably, the detents 86 are sufficiently biased so as to allow easy operation of the adjustment side knob 89 but so as to prevent accidental operation. Additionally, the detents 86 and detent seats 87 are preferably adapted so as to provide an audible and/or a felt click for each change of position of the detents 86 from their initial positions in the detent seats 87 to adjacent positions in the detent seats 87. The audible and/or a felt click would be sufficient to be detected by the operator but not generally detectable by others, even if nearby. This preferred feature provides for quick and reliable adjustment of coarse elevation from one elevation setting to another in low light or darkness.

Operation of the adjustable mount of this embodiment would be provide a simple numbered position system where each of step in the stepped angled slot would correspond to different amount of units or measure of elevation. For example, each numbered position could correspond to a selected number of units of m.o.a. of elevation, as contemplated in the description above. The advantage of such a cam profile (a stepped angled slot) is that the operation of the adjustable mount of this embodiment is limited to a few known and predictable positions for the shooter and the advantage of the cam capture means (a hand driven rack and pinion mechanism) of this embodiment is that the time for making an adjustment is greatly reduced, as compared to a position dial, without compromising accuracy and repeatability.

Variations (Not Shown)

In an alternate embodiment (not shown), the elevation cam has a gear rack disposed on the surface of the cam itself in lieu of an elevation cam positioning rod. The pinion gear is disposed adjacent the gear rack and the cam bore is modified to accommodate a tangential intersection of the pinion bore.

In alternate slide variations (not shown) of the preferred embodiments of the present invention, an elevation cam cylinder with a stepped angle slot is mechanically captured to a slide lever affixed to the elevation cam positioning rod. The positioning rod is slidably disposed in a longitudinal bore in the adjustable sub-base extending from the elevation cam cylinder bore and is further disposed in a longitudinal bore in a housing attached to the threaded hole in the adjustable sub-base of the first two preferred embodiments (in lieu of the previously described threaded barrel).

In a first variation a transverse slot is disposed in the housing and intersects the longitudinal bore. A lever is attached to the positioning rod and extends through the transverse slot so as to terminate in a protruding thumb knob. A biased detent rod is disposed in a detent bore located in the housing and intersecting the longitudinal bore. The biased detent rod is sequentially received into a series of detent seats is disposed in the positioning rod, each detent seat disposed corresponds to a selected displacement of the elevation cam such that the elevation pin is displaced from one step of the stepped angled slot to an adjacent step of the slot. Preferably, the detent is biased so as to allow easy operation of the thumb knob but sufficiently biased so as to prevent accidental operation. Additionally, the detent and detent seats are preferably adapted so as to provide an audible and/or a felt click for each change of position of the detent from its initial position in a detent seat to adjacent position in the detent seat. The audible and/or a felt click would be sufficient to be detected by the operator but not generally detectable by others, even if nearby.

In a second variation of this alternate embodiment the housing is shortened so as to allow the longitudinal bore to penetrate the rear of the housing. Thus, no transverse slot is required, but a plunger handle or, alternately, a knob is disposed on the end of the positioning rod distal to the elevation cam cylinder with the stepped angled slot. The detent mechanism or this second variation corresponds to the detent mechanism of the first variation. The operator pushes or pulls the plunger handle to position the elevation cam. These two variations of preferred embodiments allow for rapid, quiet adjustment of the adjustable elevation mount corresponding to simple, easy to recognize positions while in a shooting position with the shooter's hands stationary except for use of the thumb of the shooting hand to operate the thumb knob or plunger.

Fourth Embodiment

The previously described third preferred embodiment and its variations provides a means of setting coarse elevation quickly and precisely in conditions of very low visibility where an illumination device would be undesirable. However, in some low visibility circumstances fine adjustment of the elevation setting by means of an adjustable mounting system is desired. In this fourth preferred embodiment an elevation cam cylinder having a smooth angled slot is mechanically captured to a position dial adapted to provide audible and/or felt indication of changes in the elevation setting so as to provide fine bi-directional control of elevation adjustments of the adjustable telescopic mounting system in low visibility conditions. Additionally, this fourth preferred embodiment provides for rapid adjustment of the pivot mount without the necessity of tools so as to provide a coarse windage adjustment and so as to correct for inherent miss-alignment found in the rail base being attached to a firearm's action. This feature provides a high degree of flexibility and control sight mount adjustments in adverse or low visibility conditions while a shooter remains in a shooting position. In this embodiment, as shown in FIGS. 13*c*, 14*b*, 15*b*, 17*a* and 17*b*, the bi-directional elevation cam 36 has been captured to a position dial 38 modified to cooperate with a detent mechanism disposed within the adjustable sub-base body 26. Additionally, the pivot mount 12 has been modified to allow rotation in three degrees of freedom by incorporation of a spherical pivot mount 212.

Adjustable Elevation Mount

Figure 13A:
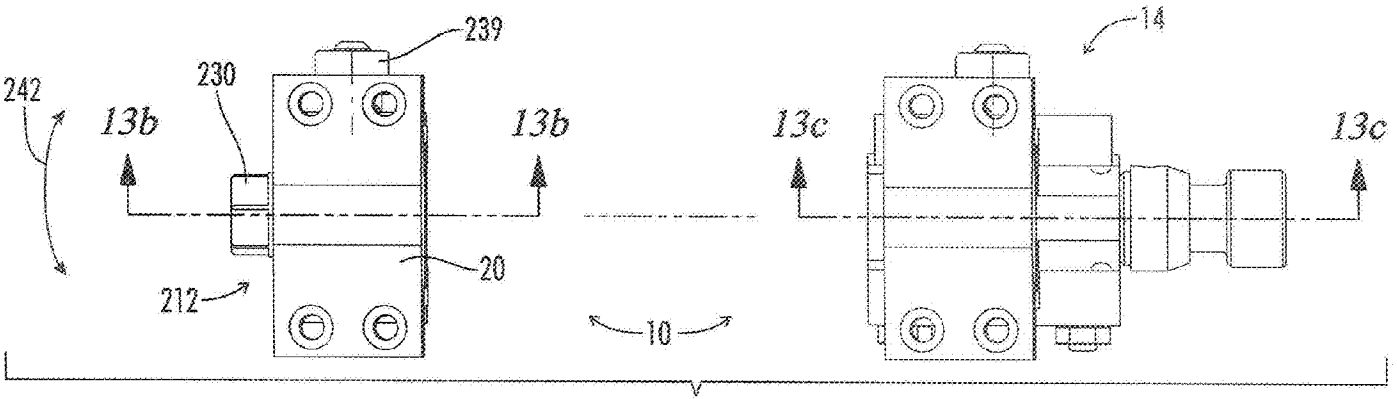
FIG. 13*a* is an overhead view of a fourth preferred embodiment of the adjustable mounting system of the present invention including the apparatus of FIG. 13*b* and the apparatus of FIG. 13*c*.
Figure 13C:
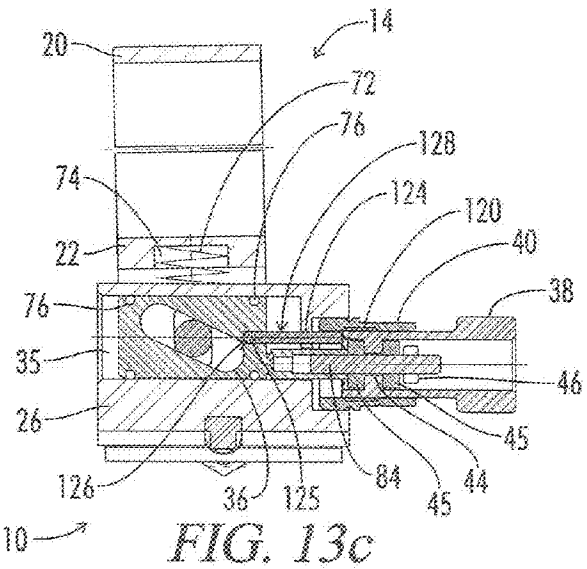
FIG. 13*c* is a longitudinal cross-sectional view of the adjustable scope mount of the adjustable mounting system of FIG. 13*a*.
Figure 17A:
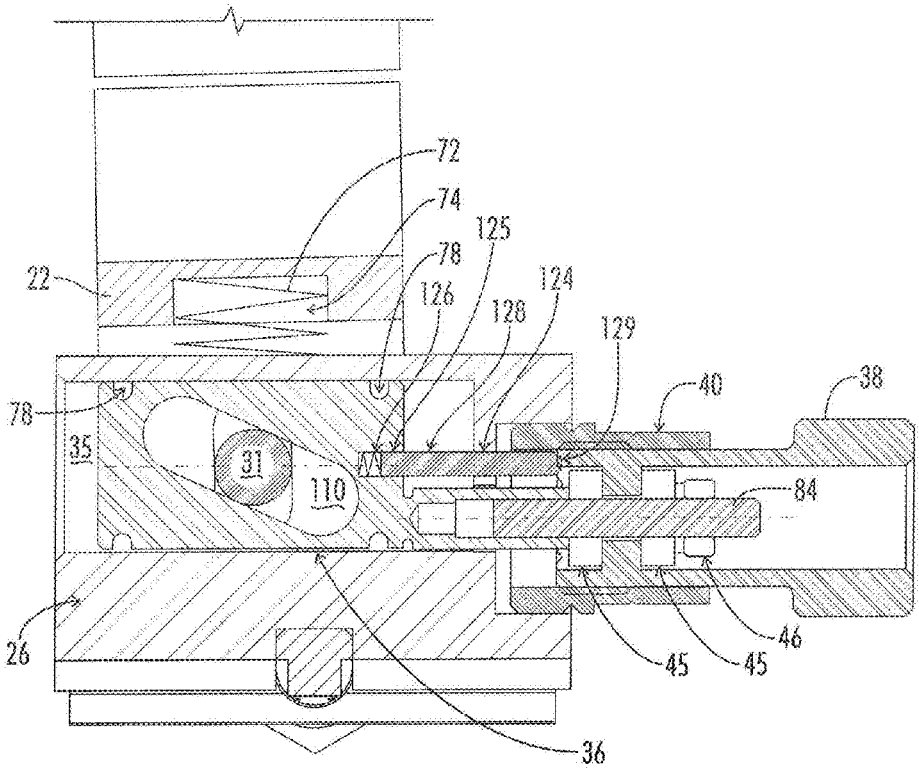
FIG. 17*a* is a detailed view of the dial thimble of the apparatus of FIG. 17*b*.
Figure 17B:
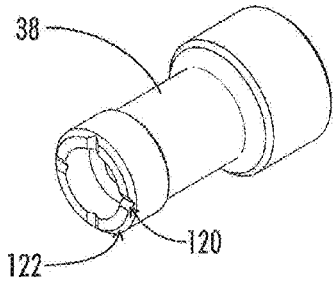
FIG. 17*b* is a longitudinal cross-sectional view of the adjustable scope mount of FIG. 13*c*.

FIGS. 13*c*, 17*a* and 17*b* show an adjustable elevation mount 14 of this fourth preferred embodiment. The elevation pin 31 is shown in FIG. 17*a* disposed in the smooth angled slot 110 of the elevation cam cylinder 36, which is itself disposed in cam bore 35 of the adjustable sub-base body 26. The elevation cam positioning rod 37 is attached to a connection stud 84, which extends into the bore of an internally threaded barrel 40. A first portion of the barrel 40 is fixedly disposed in a bore in the adjustable sub-base body 26 and a second portion extends rearward. An externally threaded dial thimble 38 is disposed within the barrel 40 so as to rotatably engage the internal threads of the barrel 40. The distal end of the positioning rod 37 is disposed against a first thrust bearing 45. The connection stud 84 extends from the positioning rod 37, through a bore in the first thrust bearing 45, through a journal bearing disposed within the dial thimble 38 and through a bore in a second thrust bearing 45. A nut 46 and washer tighten the bearing assembly such that the externally threaded dial thimble 38 can freely rotate within the internal threads of the barrel 40 but is prevented from being slidably displaced along the connection stud 84 so as to mechanically capture the elevation cam 36 to the dial thimble 38.

The thimble 38 has a series of detent seats disposed in a circumferential rim 122 proximal to the elevation cam cylinder 35. A cam detent bore 125 is disposed in the elevation cam cylinder 36 and is aligned with a sub-base detent bore 124 disposed through a portion of the sub-base body 26. A detent rod 128 is slidably disposed in the cam detent bore 125 and through the sub-base detent bore 124. A detent spring 126 is disposed in the cam detent bore 125 behind one end of the detent rod 128 and biases the distal hemispherical end 129 of the detent rod 128 against the circumferential rim 128 of the thimble 38.

The elevation cam cylinder 36 is fixed in relative distance to the thimble 38 by the connection stud 84 upon which the thimble 38 is rotably mounted. Thus, as the thimble 38 rotates in threaded engagement within the barrel 40, the thimble is longitudinally displaced. The elevation cam cylinder 36 is mechanically captured by the thimble 38 as described above. Thus the elevation cam cylinder 36 is displaced within the cam bore 35 an equal distance and the elevation pin 31 is vertically displaced a distance proportional to the angle of the angled slot 110 and the distance of longitudinal displacement.

The pitch of the mated threads and the diameter of the thimble determine the longitudinal displacement of the elevation cam cylinder 36 corresponding to a revolution of the thimble 38. The proportional vertical displacement of the elevation pin 31 corresponding to a revolution of the thimble 38 is similarly determined. Selection of the number of detent seats 120 in the circumferential rim 122 of the thimble 38 determines the vertical displacement of the elevation pin 31 corresponding to rotation of the thimble 38 from the detent rod 128 displaced from one detent seat 120 to an adjacent detent seat 120. Preferably, the detent rod 128 is sufficiently biased so as to prevent accidental operation but also to allow easy operation of the thimble 38. Additionally, the detent 128, hemispherical end 129 and detent seats 120 are preferably adapted so as to provide an audible and/or a felt click for each change of position of the detent rod 124 from an initial position in the detent seats 120 to a position in an adjacent detent seat 120. The mechanical motion of the detent rod 124 moving into the detent seat 120 with the force of the compressed spring 126 behind the detent rod 128 will cause a faint audible sound and also a felt semi-locked position of the thimble 37. Though the detent position is easily overcome by continued rotational force from the shooter, this fourth preferred embodiment does give indication that the thimble 38 is at the next indexed position. The audible and/or a felt click would be sufficient to be detected by the operator but not generally detectable by others, even if nearby. Thus, the cam capture means of this preferred embodiments provides for quick and reliable adjustment of elevation from one elevation setting to another in low light or darkness.

The adjustable elevation mount 14 also includes a bias means biasing the ring bearing clevis 22 away from the adjustable sub-base body 26. A lifter spring cavity 74 is disposed in the ring bearing clevis 22 and a lifter spring 72 is positioned therein. The lifter spring 72 under compression exerts a tensile force on both the lower portion of the ring bearing clevis 22 and the upper portion of the adjustable sub-base body 26. This removes inherent mechanical clearances present in the assembly of the ring bearing clevis 22 to the adjustable sub-base body 26, which improves the accuracy of elevation adjustments of adjustable elevation mount 14.

The adjustable elevation mount 14 additionally includes O-rings 76 are positioned in O-ring grooves 78 disposed in the elevation cam cylinder 36 of the adjustable elevation mount 14 to protect cam bore 35 and cam from environmental contaminants such as fine dust, sand, etc.

Spherical Pivot Mount

In this fourth preferred embodiment shown in FIGS. 11*a*, 11*b*, 12, 13*a*, 13*b*, 14*a*, and 15*a*, a pivot mount has been modified to allow rotation in three degrees of freedom by incorporation of a spherical pivot bushing 220 to form a spherical pivot mount 212. A threaded cylindrical bore 216 ending in a generally hemispherical cavity 218 is longitudinally disposed in the fixed sub-base body 214 so as to form a hemispherical seat 219 for receiving a spherical bushing 220. An oversized pivot hole 225 is laterally disposed in the fixed sub-base body 214 so as to intersect the hemispherical cavity 218. A spherical bushing 220 having a spherical bushing inner bore 224 is placed in the hemispherical seat 219. A pair of cylindrical bushings 226 having a cylindrical bushing bore 228 is disposed in the oversized pivot hole 225 on either side of the spherical bushing 220 such that the spherical bushing inner bore 224 and the cylindrical bushing bores 228 align with the oversized pivot hole 225. The spherical bushing inner bore 224 and the cylindrical bushing bores 228 are sized to form a close fit with the outer diameter of a pivot pin 224.

Figure 12:
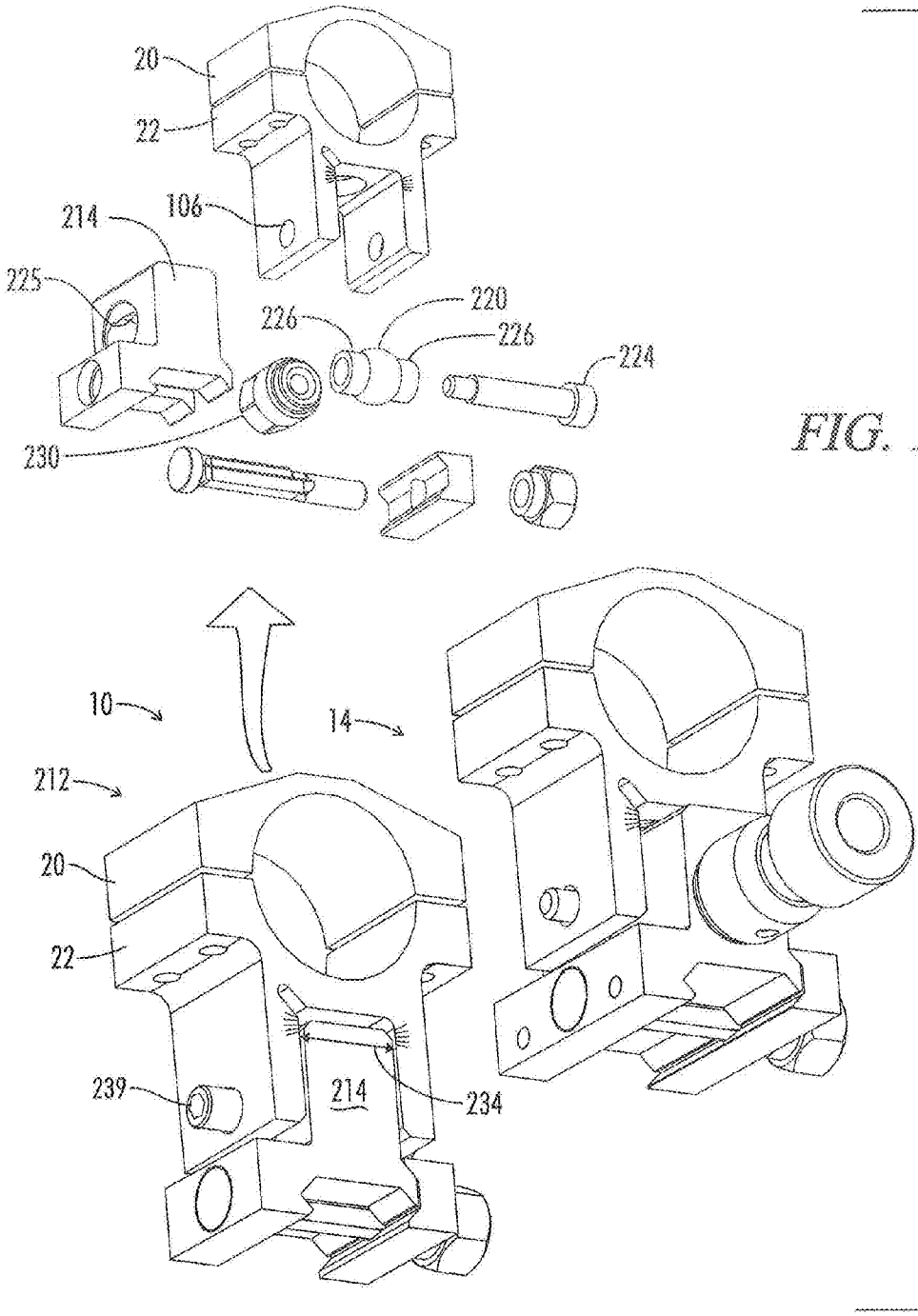
FIG. 12 is an oblique view of the apparatus of FIG. 11*b*, shown assembled in the lower portion of FIG. 12 and partially exploded in the upper portion of FIG. 12.

The ring bearing clevis 22 is positioned over the fixed sub-base body 214 such that the clevis pivot hole 106 and the oversized pivot hole 225 are aligned. Pivot pin washers 236 are inserted in sized recesses in the clevis pivot hole 106. A pivot pin 224 is disposed through the washers 236 and the bores of the bushings 220, 226. The spherical bushing 220 and the two cylindrical bushings 226 are sized such that their combined lateral dimension provides a close fit with the inner clevis dimension 234 (shown in FIGS. 11*a* and 12) upon tightening of a fastener such as a locking handle 238 (FIG. 11*b*) or a locking nut 239 (FIG. 12). A locking setscrew 230 having a concave hemispherical seat 232 is threaded into the cylindrical bore so as to contact the spherical bushing 220. Upon tightening the spherical bushing 220 is locked in position relative to the spherical set 219.

Figure 13B:
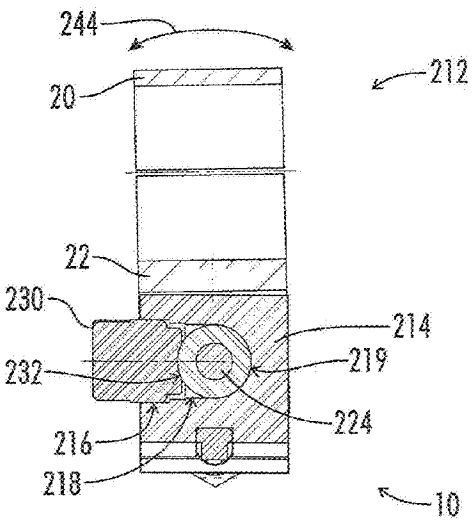
FIG. 13*b* is a longitudinal cross-sectional view of the apparatus of FIG. 11*b*.
Figure 14A:
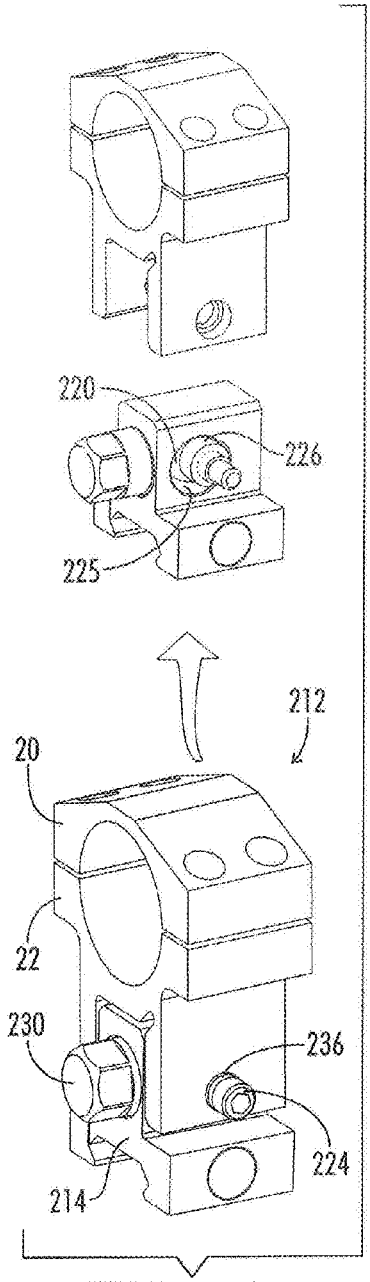
FIGS. 14*a* and 14*b* are front oblique side views of the apparatus of FIGS. 13*b* and 13*c*. Each view is shown assembled in the lower portion and exploded in the upper portion.
Figure 14B:
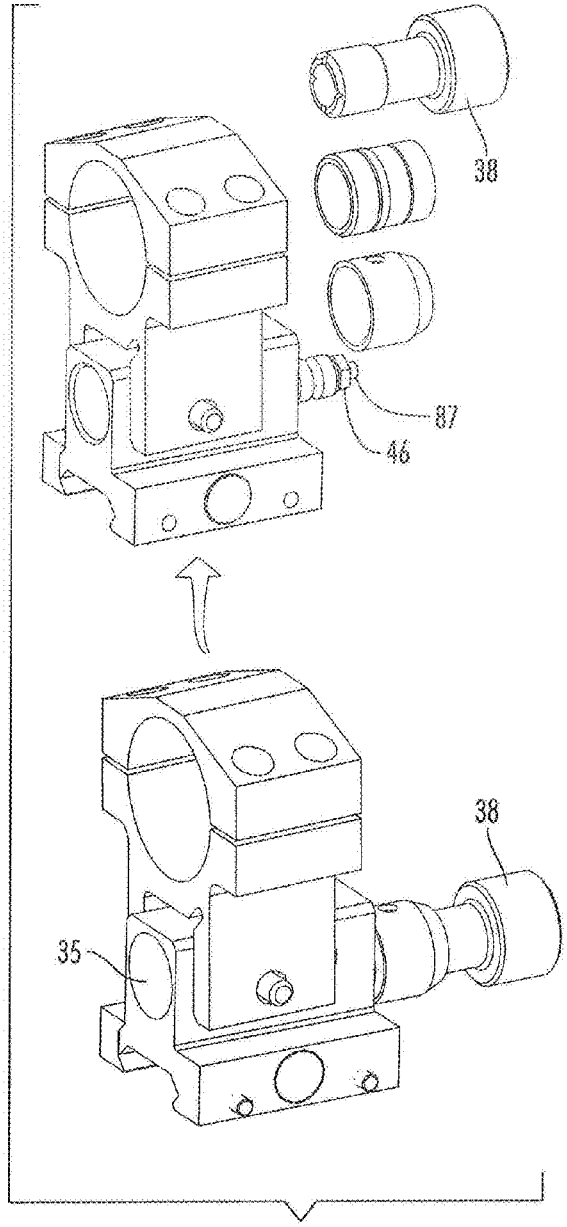
Figure 15A:
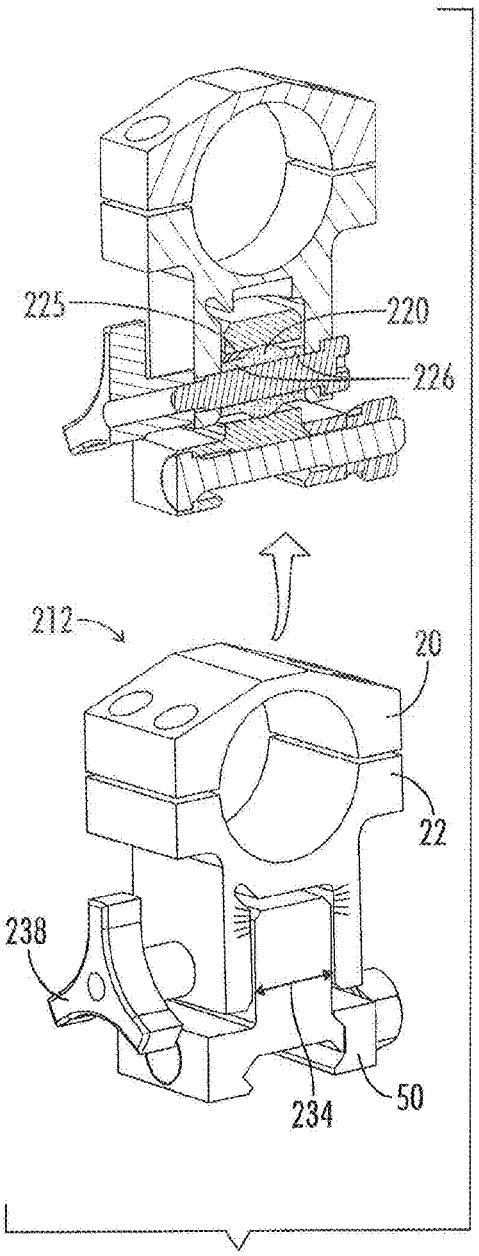
FIGS. 15*a* and 15*b* are rear oblique side views of the apparatus of FIGS. 13*b* and 13*c*. Each view is shown in whole in the lower portion and partially sectioned in the upper portion.
Figure 15B:
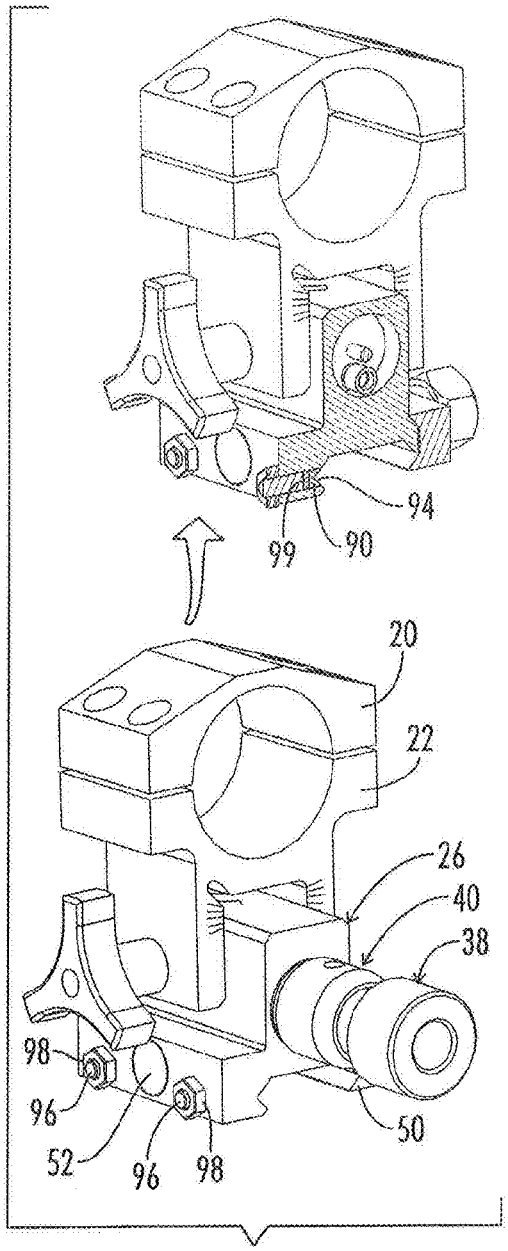

Referring now to FIGS. 13*a*, 13*b* and 13*c* and with a sighting device (not shown) disposed in the spherical pivot mount 212 and the adjustable elevation mount 14 of this fourth embodiment of the adjustable mounting systems 10, the locking setscrew 230 and the locking nut 239 are loosened but not removed. The ring bearing clevis 22 may then be rotated about a first arc of rotation 240 (shown in FIG. 11*b*) and a second arc of rotation 242 (shown in FIG. 13*a*) relative to fixed sub-base body 214 by rotation of spherical bushing 220 relative to the spherical seats 219. The ring bearing clevis 22 may also be rotated about a third arc of rotation 244 (shown in FIG. 13*b*) relative to fixed sub-base body 214 both by rotation of spherical bushing 220 relative to the spherical seats 219 and by rotation of the pivot pin 224 relative to the spherical seat 219. This preferred feature provides for quick and reliable adjustment of the adjustable mounting system 10 to account for miss-alignment or warping of the firearm base rail 56 (FIG. 2) and, if desired, to provide a gross windage adjustment. This preferred feature also provides for quick and reliable pivoting of the ring bearing clevis 22 relative to the fixed sub-base body 214 so as to accommodate desired coarse elevation adjustment of the adjustable elevation mount 14. Yet additionally, this preferred feature provides for a means of preventing or relieving mechanical stress of miss-alignment and warping that a sighting device disposed within the adjustable mounting system might otherwise encounter. After the desired adjustment are made, the locking setscrew 230 is tightened so as to fix the position of the spherical bushing 220 in the spherical seat 219 and the locking nut 239 is tightened so as to fix the ring bearing clevis 22 upon fixed sub-base body 214.

Fifth Embodiment

The previously described fourth preferred embodiment provides a means of setting permit coarse windage adjustment by providing rotation of a ring bearing clevis 22 in three degrees of freedom relative to a fixed sub-base body 214 of a spherical pivot mount. It is desirable to provide an additional means of coarse windage adjustment with a greater adjustment range than may be readily achievable by the use of the spherical pivot mount 212 alone.

Figure 16C:
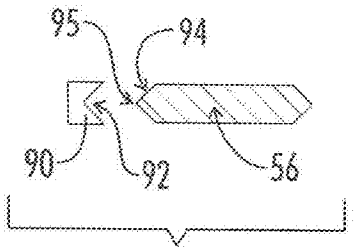
FIG. 16*a* is a left side view of the adjustable scope mount of a fifth preferred embodiment of the adjustable mounting system of the present invention.
FIG. 16*b* is a lateral cross-sectional view of the apparatus of FIG. 16*a*.
FIG. 16 *c* is an exploded, detailed view showing the relation of a windage gib to a base rail.
Figure 16B:
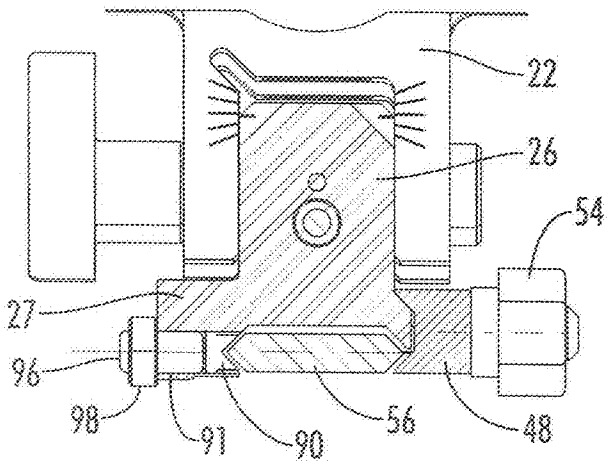
Figure 16A:
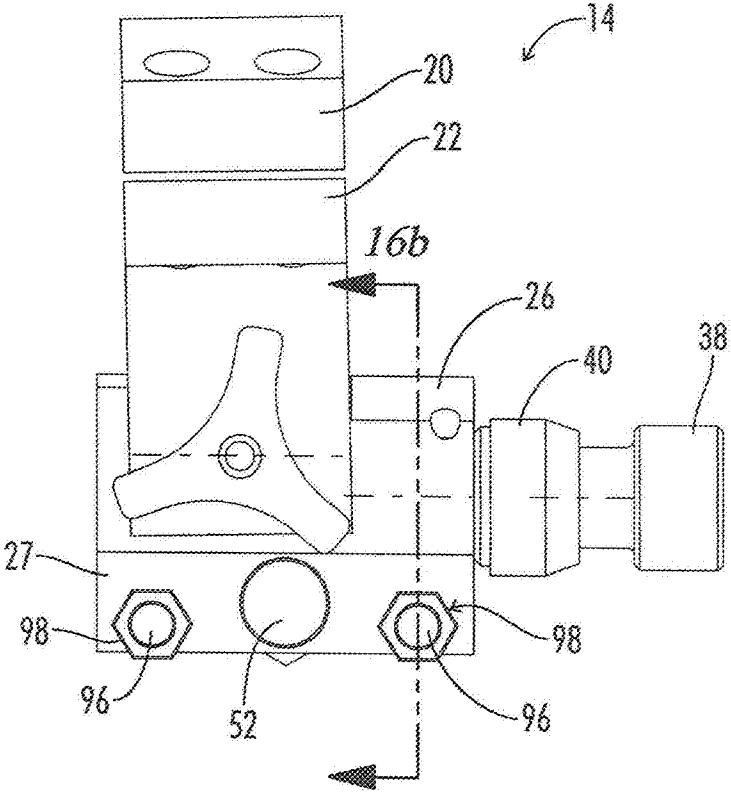

This fifth preferred embodiment of the adjustable mounting system of the present invention has provides for use of windage gibs with modified sub-base bodies of any or all of a pivoting mount 12, a spherical pivot mount 212 or an adjustable elevation mount 14. In this fifth preferred embodiment, as shown in FIGS. 16*a* and 16*b*, two threaded gib bores 92 are disposed in the lower portion 27 of an adjustable sub-base 26 so as to intersect the sub-base axial slot 29 fitting the base rail 56 and align with the to the center edge 95 of the base rail 56. A gib 90 is inserted into each gib bores 92. Each gib 90 has a gib "V" seat which securely receives the protruding "V" surfaces 94 of the base rail 56. A setscrew 96 is threaded into each gib bore 92 and is rotated as necessary to displace each gib 90 to its seated adjustment point. A locknut 98 is attached to the exposed portion of each setscrew 96 to lock each combination of setscrew 96 and gib 90 into their adjusted position and provide a selected lateral displacement of the adjustable sub-base 26 relative to the base rail 56.

In operation, each gib 90 is forced against the rail base 56 to different transverse locations such that, when the rail clamp bolt 52 is tightened to seat the adjustable sub-base 26 on the base rail 56, the pair of gibs 90 will seat the adjustable sub-base 26 at an angle compared to the base rail axis 57. To adjust the windage of the adjustable scope mount 14, the rail clamp bolt 52 will be loosened and one or the other setscrew 96 will be tightened so as to push further inward the associated gib 90 and cause causing the aim-point of the telescopic sight mounted in the adjustable mounting system 10 to change in relation to the base rail axis 57 and the bore of the firearm.

In other embodiments of the present invention, a gib is mechanically captured by a positioning mechanism (such as a set screw having the gib formed in one end of the setscrew) and is adapted to have bi-directional adjustment of the windage gib.

The present invention contemplates elevation cams and cam bore 35*s* of any complimentary combination of shapes that provide for bi-directional displacement of the elevation cam along the cam bore 35.

The present invention contemplates similar mechanical capturing of a windage adjustment dial to a cylindrical windage cam to provide bi-directional control of windage adjustments of adjustable telescopic mounting systems. Such captured bi-directional control of windage adjustments would result in increased accuracy, limited recoil effect, and simplified field adjustment mechanisms.

The present invention also contemplates similar mounting systems for non-telescopic thermal imaging scopes and telescopic and non-telescopic amplified light imaging optical scopes, for other aiming or sighting devices, for laser target illumination devices and for laser ranging devices.

Thus, although there have been described particular embodiments of the present invention of a new and useful Adjustable Scope Mounting System, it is not intended that such references be construed as limitations upon the scope of this invention except as set forth in the following claims.

What is claimed is:

1. A spherical pivot mount for a scope mounting system, the spherical pivot mount comprising:

a sub-base having a longitudinal bore terminated in a generally hemispherical cavity defining a hemispherical seat and further having a lateral bore intersecting the hemispherical cavity, the lateral bore having an oversized diameter;

a clevis bearing a mounting ring, each side of the clevis having a clevis bore, the clevis disposed on the sub-base so as to dispose the lateral bore between and aligned with the two clevis bores;

a pivot pin extending through a first clevis bore, the lateral bore and the second clevis bore, the pivot pin adapted to support the ring bearing clevis; and a generally spherical bushing disposed on the pivot pin, the spherical bushing further disposed in the hemispherical cavity and received in the hemispherical seat.

2. The spherical pivot mount of claim 1 further comprising:

a first cylindrical bushing disposed on the pivot pin between the spherical bushing and a first side of the clevis; and wherein, the pivot pin includes a retaining head disposed on one end and an adjustable fastener disposed on the other end, wherein, a lateral axis is defined relative to the sub-base, wherein, the clevis is affixed to the pivot pin so as to provide for rotation of the clevis relative to the lateral axis of the sub-base, and wherein, the adjustable fastener is adapted to selectably allow or prevent rotation of the clevis relative to the lateral axis of the sub-base.

3. The spherical pivot mount of claim 2 further comprising:

a locking setscrew having a concave hemispherical seat threadably disposed in the longitudinal bore so as to contact the spherical bushing, wherein, a vertical axis and a longitudinal axis are defined relative to the sub-base, wherein, the oversized diameter is selected so as to allow rotation of the clevis relative to the longitudinal axis of the sub-base and so as to allow rotation of the clevis relative to the vertical axis of the sub-base, wherein, the locking screw is adapted to selectably allow or prevent rotation of the clevis relative to the longitudinal axis and the vertical axis of the sub-base.

4. An adjustable scope mounting system comprising:

an adjustable elevation mount comprising:

a first ring bearing clevis;

a first sub-base having a cam bore and an intersecting vertical slot, the first sub-base adapted for insertion into the first ring bearing clevis;

an elevation cam having an angled slot disposed therein, the cam movably disposed in the cam bore;

an elevation pin movably disposed through the vertical slot and through the angled slot, the vertical slot and the angled slot cooperating to hold the elevation pin at a vertical position corresponding to the position of the elevation cam within the cam bore, the elevation pin adapted to support the first ring bearing clevis; and a bi-directionally operable cam capture means having selectable magnitudes of operation, the cam capture means adapted such that operation of the cam capture means causes displacement of the elevation cam through the cam bore in a direction and distance determined by the direction and magnitude of operation of the cam capture means, wherein, the displacement of the elevation cam causes vertical displacement of the elevation pin within the vertical slot; and a spherical pivot mount comprising:

a second sub-base having a longitudinal bore terminated in a generally hemispherical cavity defining a hemispherical seat and further having a lateral bore intersecting the hemispherical cavity, the lateral bore having an oversized diameter;

a second clevis bearing a second mounting rind, each side of the second clevis having a clevis bore, the second clevis disposed on the second sub-base so as to dispose the lateral bore between and aligned with the two clevis bores;

a pivot pin extending through a first clevis bore, the lateral bore and the second clevis bore, the pivot pin adapted to support the second clevis; and a generally spherical bushing disposed on the pivot pin, the spherical bushing further disposed in the hemispherical cavity and received in the hemispherical seat.

5. The apparatus of claim 4, wherein at least one of the first sub-base and the second sub-base further comprise:

a lower portion having an axial slot adapted to receive a base rail having a clamping surface, the lower portion having a first clamping seat, the lower portion further having a gib bore disposed so as to intersect the axial slot;

a gib having a gib clamping seat adapted to receive the clamping surface of the base rail, the gib disposed in the gib bore so as to align with such base rail as is receivable in the axial slot;

a positioning means disposed in the gib bore and adapted to position the gib clamping seat against the clamping surface of such base rail so as to provide an offset distance between the first clamping seat and the clamping surface.

* * * * *

UNITED STATES PATENT AND TRADEMARK OFFICE

CERTIFICATE OF CORRECTION

PATENT NO. : 7,543,405 B1
APPLICATION NO. : 11/592605
DATED : June 9, 2009
INVENTOR(S) : Stephen Ivey It is certified that error appears in the above-identified patent and that said Letters Patent is hereby corrected as shown below:

Column 3, line 27, delete "the" after --opposing--;
Column 5, line 39, insert --a-- after --about--;
line 52, replace "miss-alignment" with --misalignment--;
line 62, delete "the to" prior to "the center edge";
Column 6, line 30, replace "miss-alignment" with --misalignment--;
Column 9, line 37, replace "leaver" with --lever--;
Column 11, line 20, replace "provides" with --provided--;
Column 12, line 14, delete "be" after --would--;
line 15, delete "of" after --each--;
line 52, after "seats" insert --and--;
Column 13, line 31, replace "miss-alignment" with --misalignment--;
Column 15, line 56, replace "miss-alignment" with --misalignment--;
line 63, replace "miss-alignment" with --misalignment--;
Column 16, line16, replace "provides" with --provided--;
line 23, delete "to the" after --with the--;
line 24, replace "bores" with --bore--;
Column 18, line 25, replace "rind" with --ring--.

Signed and Sealed this

First Day of September, 2009

David J. Kappos

David J. Kappos
*Director of the United States Patent and Trademark Office*